United States Patent [19]

Hercog et al.

[11] Patent Number: 5,020,248

[45] Date of Patent: Jun. 4, 1991

[54] SKI BOOT

[75] Inventors: Milan Hercog, Graz; Axel Kubelka, Obdach, both of Austria

[73] Assignee: Kastinger Skiboot GmbH, Seewalchen, Austria

[21] Appl. No.: 327,555

[22] Filed: Mar. 23, 1989

[30] Foreign Application Priority Data

Mar. 25, 1988 [AT] Austria ..... 815/88

[51] Int. Cl.[5] ..... A43B 5/04

[52] U.S. Cl. ..... 36/120; 36/117; 36/89

[58] Field of Search ..... 36/117–121, 36/89; 128/804

[56] References Cited

U.S. PATENT DOCUMENTS 4,615,127 10/1986 Delery ..... 36/117
4,724,625 2/1988 Sartor ..... 36/117

FOREIGN PATENT DOCUMENTS 2107659 9/1972 Fed. Rep. of Germany ..... 36/117
3721620 1/1988 Fed. Rep. of Germany ..... 36/119
3808652 11/1988 Fed. Rep. of Germany ..... 36/117

*Primary Examiner*—Paul T. Sewell
*Assistant Examiner*—Thomas Hilliard
*Attorney, Agent, or Firm*—Lackenbach Siegel Marzullo & Aronson

[57] ABSTRACT

A ski boot comprising an adjustable support for the foot positioned in the heel portion, the support being a substantially U-shaped spring (4) whose crosspiece (5) is positioned in the heel portion of the shell (7) of the boot and whose legs (6) extend forward on both sides inside the shell (7), embracing the foot substantially between the ankle and the heel-bone, the legs (6) being adjustable in various relative positions with respect to each other by an adjusting means (9; 18; 21; 24; 26; 29; 32; 33; 37 38) engaging the cross piece (5) or the legs (6).

1 Claim, 6 Drawing Sheets

SKI BOOT

Figure 1:
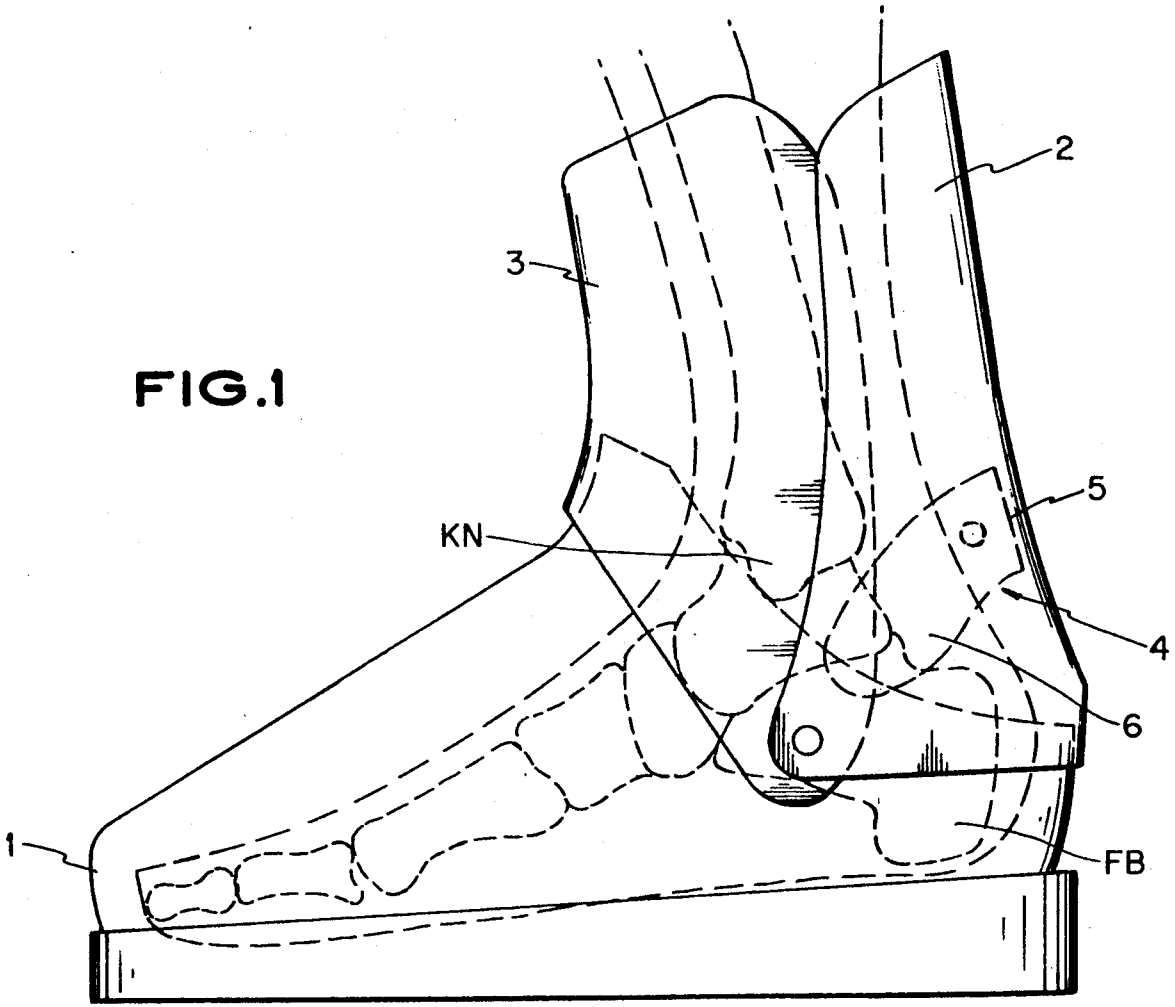

The invention relates to a ski boot comprising an adjustable support for the foot positioned in the heel portion.

In ski boots various devices have become known which are to adapt the boot to the foot of the respective user, taking into account the anatomical conditions as well as the respective positions of the foot under different skiing conditions. Among others, it has become known to support the foot in the area of the Achilles tendon by two lateral clamping jaws which can be adjusted with respect to each other by means of a spindle. However, such a support of the foot in the mentioned area has turned out to be effective only in a particular position of the foot, e.g. when the leg is upright, whereas this support is lost when the leg is leaned forward.

The object of the invention is to provide a ski boot which comprises a support for the foot in the area of the Achilles tendon, said support permitting, on the one hand, an adaptation to the individual dimensions of the foot and, on the other hand, staying effective also in different positions of the foot.

This object may be achieved with a ski boot of the type mentioned above, in which according to the invention the support is a substantially U-shaped spring whose crosspiece is positioned in the heel portion of the shell of the boot and whose legs extend forward on both sides inside the shell, embracing the foot substantially between the ankle and the heel-bone, said legs being adjustable in various relative positions with respect to each other by an adjusting means engaging the crosspiece or the legs of the spring.

The spring according to the invention embraces the foot in the area of the Achilles tendon and thereby provides an effective support for the foot even when the leg is leaned extremely forward and when the lateral faces of the foot to the left and to the right of the Achilles tendon change from a concave to a convex shape.

The invention and its further advantages are explained in greater detail by means of exemplary embodiments which are illustrated in the drawing.

Figure 3:
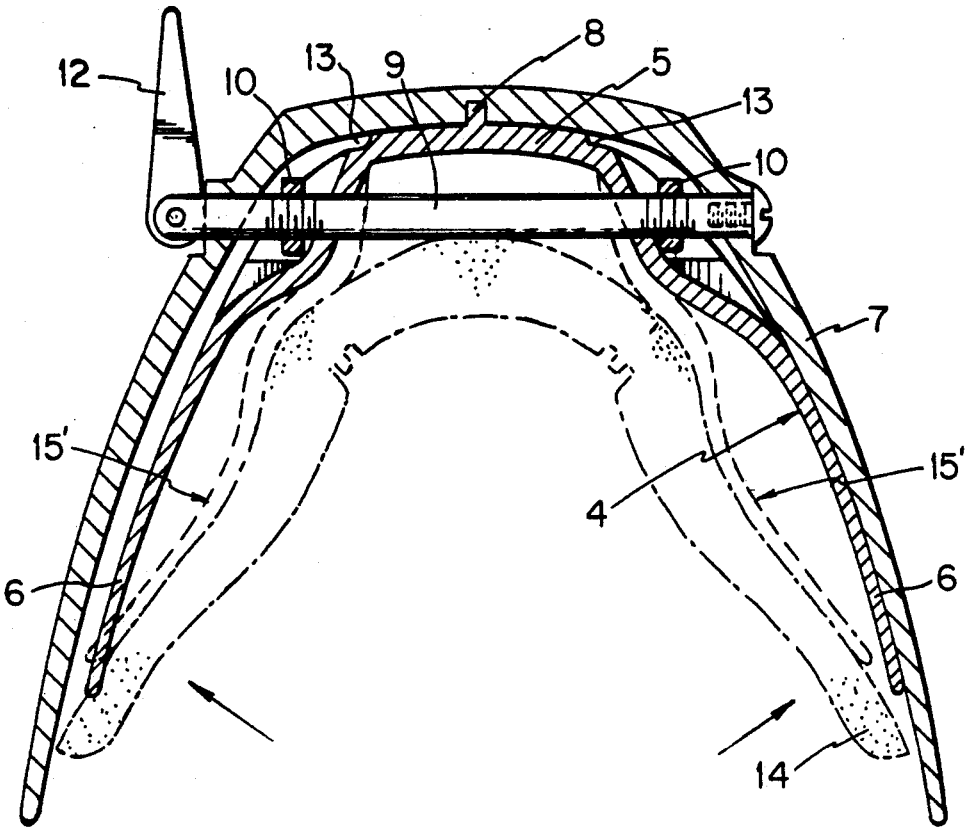
Figure 2:
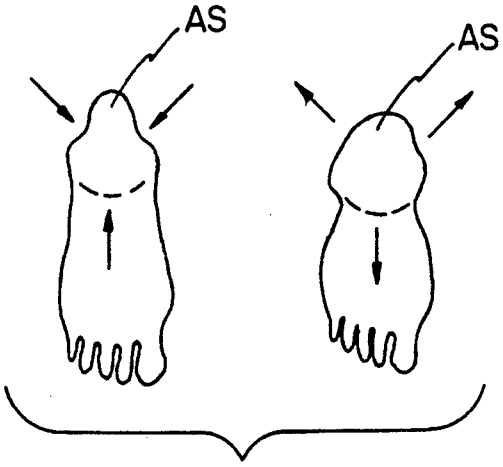
Figure 4:
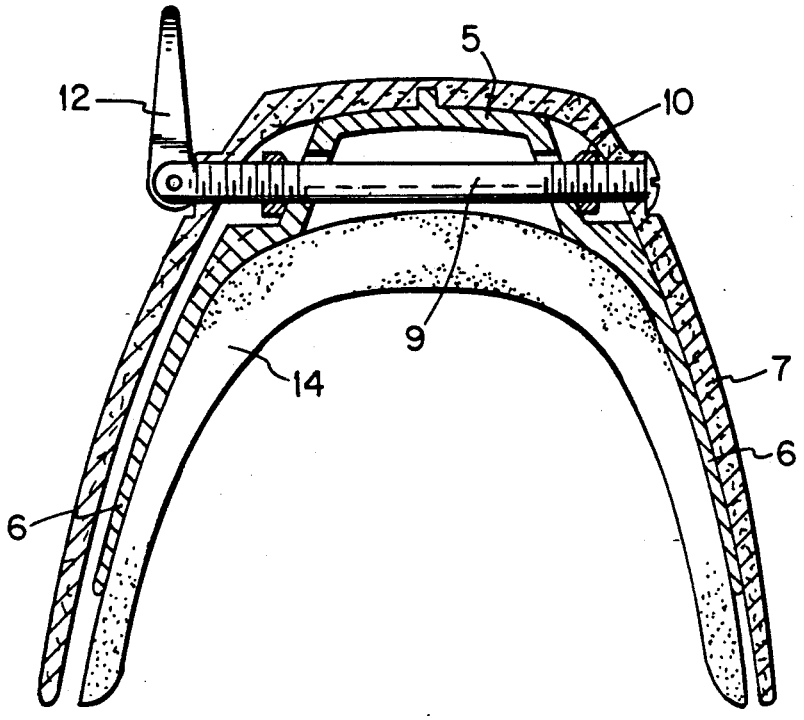
Figure 5:
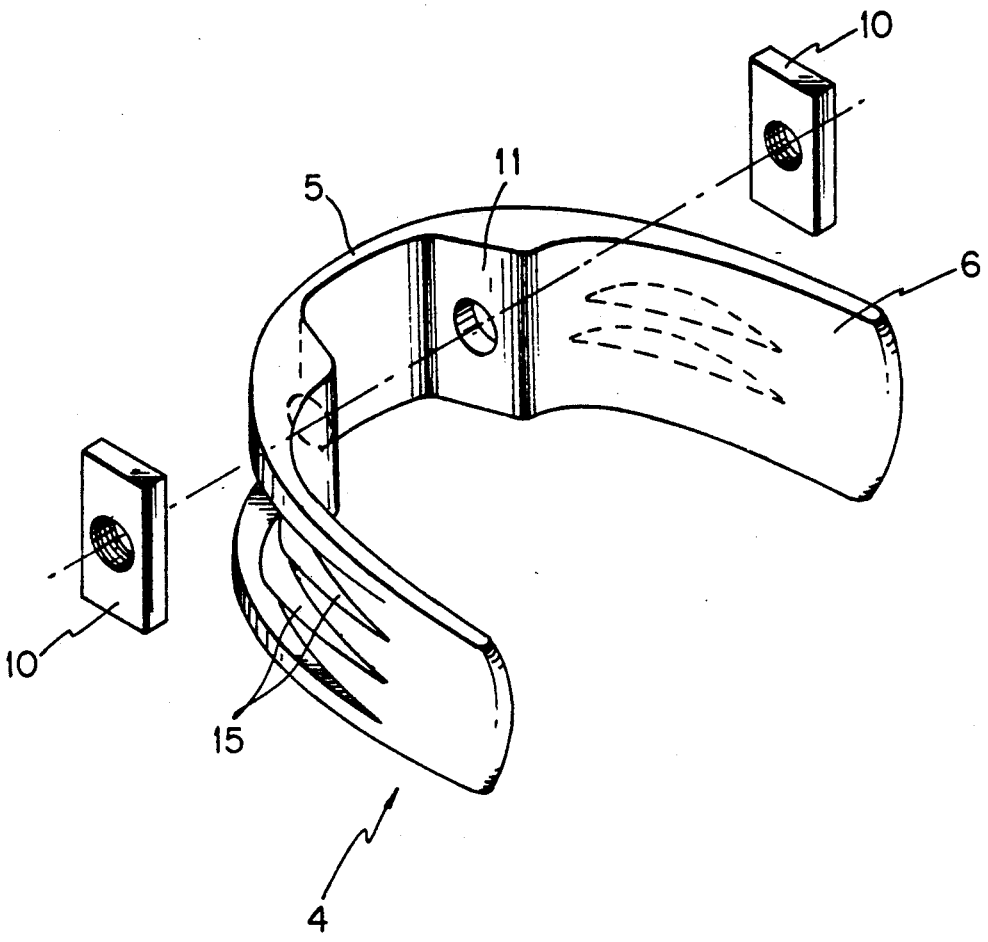
Figure 8:
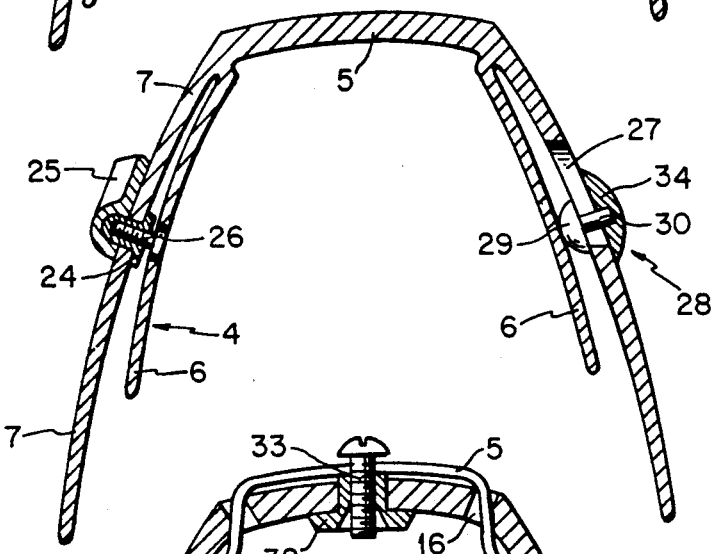
Figure 9:
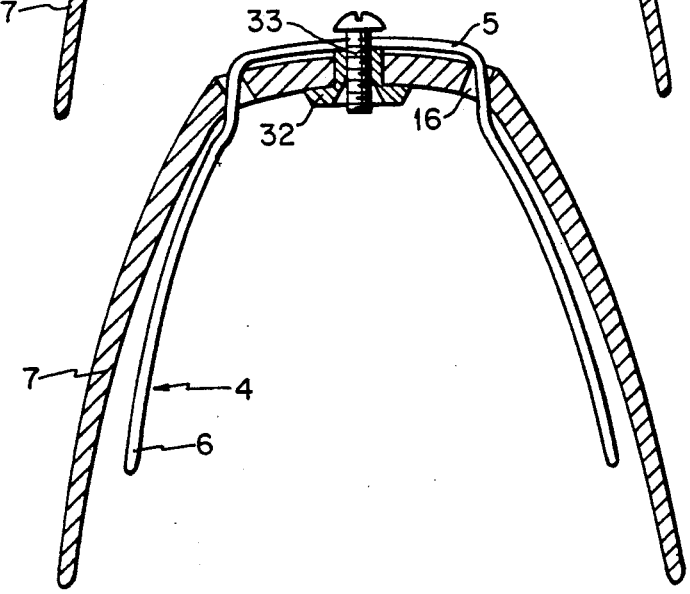
Figure 10:
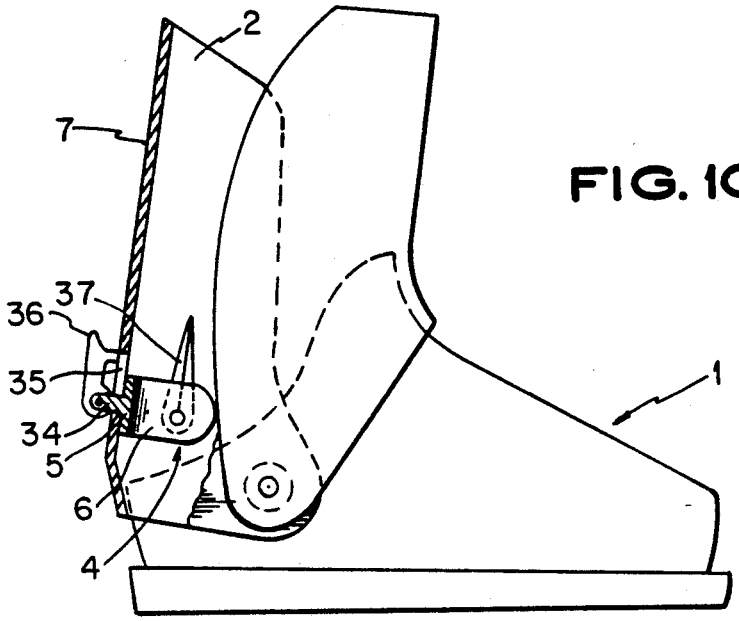
Figure 11:
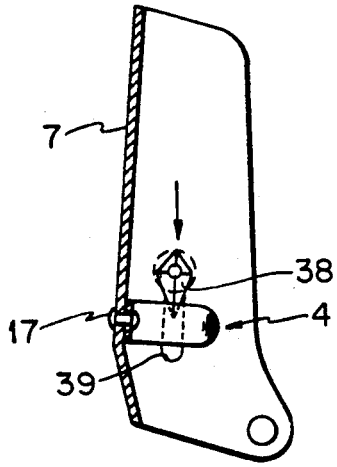
Figure 12:
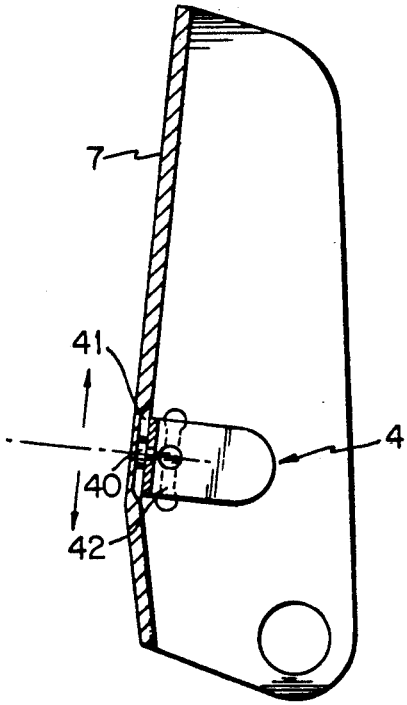
Figure 13:
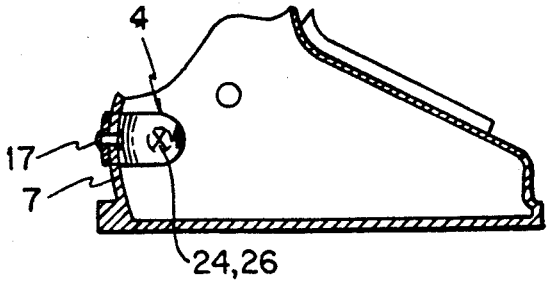

In the drawing,

FIG. 1 is a rough schematic side view of a ski boot according to the invention,

FIG. 2 is a schematic top view of the change in the shape of the foot in the area of the Achilles tendon when the leg is in the upright position or when it is leaned backward and forward, respectively, FIG. 3 is a schematic section, approximately along the legs of the spring, of the rear portion of a ski boot according to the invention, FIG. 4 is a view according to FIG. 3 of another embodiment of the invention, FIG. 5 is a perspective view of the spring used in the embodiment according to FIG. 4, FIGS. 6 to 9 are views according to FIG. 3 of further embodiments of the invention, FIGS. 10 to 12 are schematic, partly sectioned side views of three further embodiments of the invention positioned at the rear flap of a ski boot, and FIG. 13 likewise is a schematic, partly sectioned side view of an embodiment of the invention in connection with a different ski boot.

FIG. 1 discloses a ski boot of the usual design, comprising a basic shell 1 to which a rear flap 2 and a cuff 3 are pivoted. It is pointed out here that the term "shell" as used herein and in the patent claims comprises not only the basic shell, but e.g. also the rear flap. In the rear portion of the ski boot a U-shaped spring is positioned which is adjustable in the manner described below. FIG. 1 discloses, however, that this spring embraces the foot around the Achilles tendon approximately at the height between the ankle KN and the heel-bone FB with its two legs 6 projecting from a crosspiece 5. FIG. 2 is a schematic view of a foot, the drawing on the left showing the position when the leg is upright and leaned backward, respectively, and the drawing on the right showing the position when the leg is leaned forward, e.g. when skiing downhill. In the upright position of the leg the foot has concave indentations on both sides of the Achilles tendon AS which increasingly bulge outwards as the leg is leaned forward and may become convex. These anatomical conditions have to be taken into account if an effective support of the foot is to be achieved in the area of the Achilles tendon.

According to FIG. 3, the spring 4 is completely positioned inside the shell 7 of a ski boot, its crosspiece 5 resting right at the back against the wall of the shell 7 and being held in said shell by means of a centering pin or bar 8. The spring is approximately U-shaped and may be made of metal or plastic. Near the crosspiece 5 an adjusting spindle 9 extends approximately horizontally through the boot, passing through the shell 7 as well as through the legs 6 of the spring 4. On the threaded adjusting spindle 9 two nuts 10 are arranged on both sides of the legs 6, said legs 6 comprising a portion 11 staggered inwards in the area of these nuts 10. On one side, the adjusting spindle 9 extends further outwardly and is provided with a handle 12 outside the shell 7 which permits turning of the spindle 9 by hand. In the present case the handle is a lever pivoted to the spindle 9 which may also be engaged so that inadvertent turning of the spindle 9 is prevented.

In each transition region from the crosspiece 5 to the two legs 6 the spring 4 is provided with an indent 13 which creates a portion of the spring in which it may be bent particularly easily. Between the inner surfaces of the spring 4 and the foot a soft lining 14 or an inner shoe, etc. is provided in a manner known per se. By turning the adjusting spindle 9 by means of the handle 12 the mutual relative position of the two nuts 10 may be enlarged or reduced. If the adjusting spindle 9 is turned so that the nuts 10 get closer to each other, they press the legs 6 of the spring 4 against each other and press it more tightly against the foot. The dotted line 15' shows the position of the spring in that case, also showing that the front ends of the spring are pressed outwardly by the foot, but that between these ends and the crosspiece the spring legs are curved inwards, as shown by the arrow, which results in a tight enclosure of the foot even when the leg is leaned forward.

The embodiment according to FIGS. 4 and 5 corresponds substantially to the embodiment according to FIG. 3, but in this case the spring has a particular shape shown in FIG. 5. According to FIG. 5 the spring 4 likewise comprises portions 11 staggered inwards in the area of the rectangular nuts 10, with the nuts resting against the outer surfaces of these portions. However, in the direction towards the crosspiece 5 the spring is additionally provided with stiffening ribs 15 which grow thicker in the direction towards the crosspiece 5 and in this way result in a zone of greater flexural strength of the spring 4. This also results in a particularly good anatomical adaptation of the spring to the foot.

Figure 6:
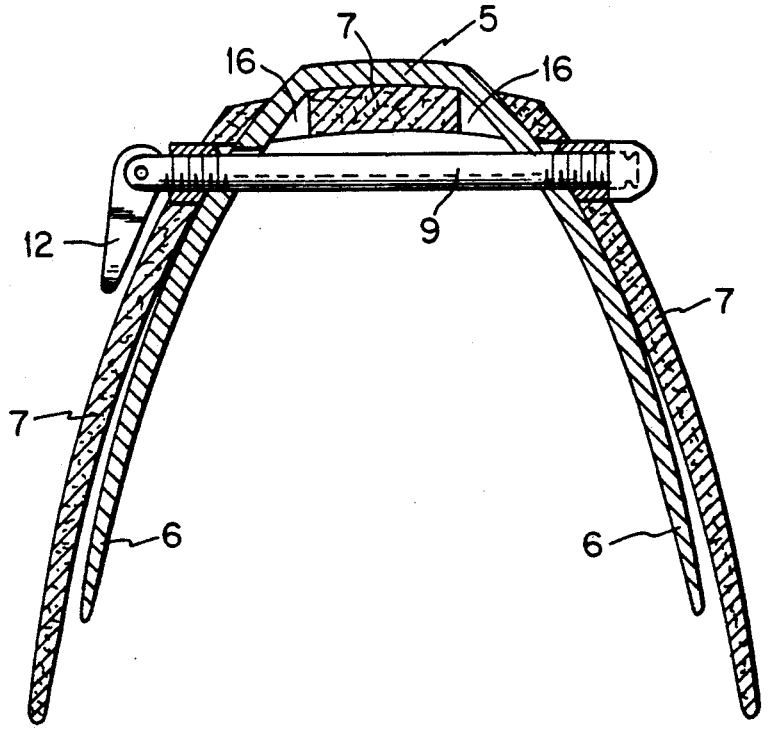

In the embodiment according to FIG. 6 the crosspiece 5 of the spring 4 is positioned outside the shell 7 and the legs of the spring extend through slots 16 in the shell 7—said slots extending substantially vertically—into the interior of the boot. The shown embodiment offers the advantage that the distance—measured in the longitudinal direction of the boot—between the crosspiece 5 and the adjusting spindle 9 may be chosen so as to be big enough, without too much room getting lost in the interior of the boot. Of course the crosspiece 5 may be covered by an additional shell portion (not shown). Here, too, by turning the adjusting spindle 9 the mutual distance between the two nuts 10, which are fixed against rotation in the shell 7, may be changed so that the two legs 6 of the spring make a pincer movement, resulting in the desired adaptation to the foot. Compared with the embodiment according to FIGS. 3 and 4 the nuts, as already mentioned, are guided in the shell and are not positioned inside the shell, which likewise results in a compact, space-saving embodiment. The slots 16 have to be wide enough so that the legs 6 have sufficient room in the area of the crosspiece 5 to make the desired movement.

Figure 7:
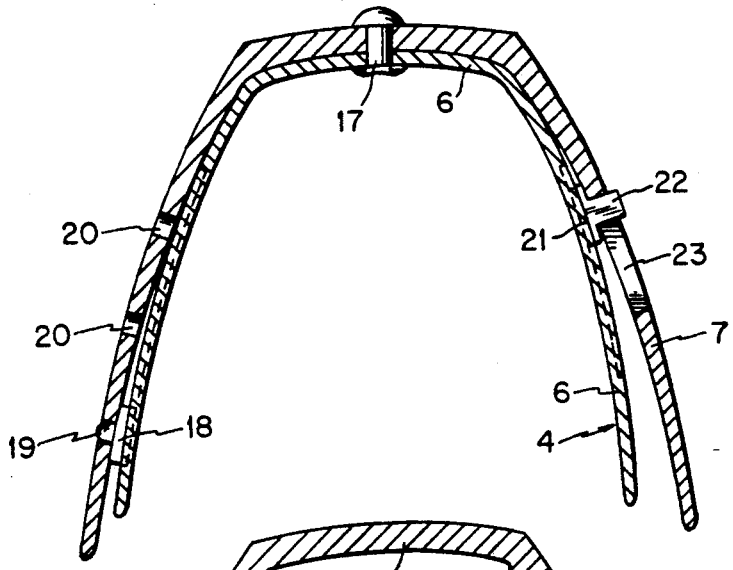

FIG. 7 shows two further embodiments of the invention, one in the left half of FIG. 7 and the other in the right half of FIG. 7. The spring 4 is positioned inside the shell 7, its leg 6 being fastened to the shell by means of a rivet 17. It is understood that in case of need a plurality of rivets may be used. As shown on the left in FIG. 7, a sliding member 18 is guided on the leg in the longitudinal direction of the leg 6, which sliding member may be shifted along the leg 6 and comprises a locking projection 19 which may alternatively be inserted into one of several boreholes 20 in the shell. The legs 6 are adjusted by pressing the leg 6 of the spring 4 away from the shell after removing the lining 14 or the inner shoe, respectively, shifting the sliding member 18 into another position and then pressing the spring 4 against the shell again whereby the locking projection 19 is inserted into another borehole. It can be seen that the spring 4 is pressed the more inwardly against the foot, the more the sliding member 19, which acts like a wedge between the shell 7 and the leg 6, is shifted backwards.

In the other embodiment shown on the right side of FIG. 7, likewise a sliding member 21 is guided along the leg 6, an operating member 22 projecting outwardly from the sliding member 21 and extending through a slot 23 in the shell so that the user of the boot may move the sliding member 21 along the leg 6 from outside.

FIG. 8 shows an embodiment in which the crosspiece 5 of the spring 4 forms one piece with the shell. Thus the two legs 6 resiliently project forwardly from the heel portion of the shell 7 which at the same time forms the crosspiece 5. The left half of FIG. 8 shows another possibility of adjusting the legs 6 by means of a bolt-nut arrangement. In this embodiment a nut 24 is rotatably supported in a borehole of the shell 7 and is provided with a handle 25 outside the shell which permits rotation. A threaded bolt 26 projects from the outer surface of the spring 4. This threaded bolt is screwed into the nut 24 and it can easily be seen that turning of the nut 24 by means of the handle 25 results in the leg 6 being drawn nearer to the shell 7 or being pushed away from the shell 7. It is understood that the position of the bolt-nut arrangement 24-26 (further in front or further at the back) affects the entire spring characteristic of the leg 6 so that the choice of that position offers another possibility of adaptation to the anatomical conditions.

FIG. 8, on the right, shows an adjusting means which acts similarly as the one according to FIG. 7. In this embodiment a sliding member 28 is guided in a slot 27 in the shell 7. This sliding member comprises an inner knob 29 and an outer knob 31 connected with the former by means of a bolt 30. The outer knob 31 serves as a handle by means of which the sliding member can be shifted along the slot 27, which causes the inner knob 29 acting like a wedge to press the resilient leg 6 more or less inwardly.

In the embodiment according to FIG. 9 which, in view of the fact that the crosspiece 5 of the spring 4 is positioned outside the shell 7, is similar to the embodiment according to FIG. 6, an adjustment of the leg by means of a bolt-nut arrangement which changes the distance between the crosspiece 5 and the outer wall of the shell 7 is possible. In this embodiment the spring 4 is biased so that the crosspiece 5 moves outwardly (arrow). A nut 32 is fixed against rotation in a borehole in the heel portion of the shell 7, and a threaded bolt extends through a corresponding borehole in the crosspiece 5 and can be screwed into the nut 32. The head of the threaded bolt 23 has a greater diameter than the corresponding borehole in the crosspiece 5 so that the crosspiece is retained by the head of the threaded bolt. Thus, when the threaded bolt is turned backwards, the crosspiece of the biased spring 4 moves backwards, which results in an inward movement of the legs 6. The head of the threaded bolt 33 may, as shown, be provided with a slot to be engaged by a screwdriver or a coin, or may be a knurled knob, lever or the like. In this connection it is pointed out that all adjusting means disclosed herein may be provided with locking means known per se to secure them against turning or shifting unless the frictional resistance present prevents such turning or shifting.

In the embodiment according to FIG. 10 the crosspiece 5 of the spring 4 is also positioned inside the shell 7, in this case the shell of the rear flap 2, a lug 34 projecting backwardly from the crosspiece 5 through a slot 35 in the shell. The slot 35 extends vertically so that the entire spring 4 can be shifted vertically. For fixing in a particular position a locking lever 36 is provided, which may be locked in various notches not shown here, optionally also spring-loaded. At the inner wall, on both sides of the shell 7, a sliding member 37 is provided, which, with a conical elevation, engages the outer surface of the legs 6. In doing so, the taper of this sliding member 37 extends in the direction of the possible vertical shift of the spring 4. In this way, a shifting of the spring 4 results in a change in the mutual distance between the legs 6 because each time a portion of different thickness of the sliding member 37 is positioned between the wall 7 and the legs 6.

An embodiment acting similarly is shown in FIG. 11. In that embodiment the spring 4 is connected with the shell by means of a rivet 17, as shown already in FIG. 7. Here, too, a conical sliding member 38 which is positioned inside the shell in the area of the legs 6 serves to adjust these legs. Contrary to FIG. 10, however, in this embodiment the sliding member 38 can be shifted along a slot 39 in the shell and the spring 4 is fixed. This constitutes a kinematic reversal of the embodiment according to FIG. 10, which, however, may offer an advantage in various ski boot designs. E.g. the bilateral, independent adjustment of the legs 6, as possible in the embodiment according to FIG. 11, may be desired in some instances.

FIG. 12 discloses an embodiment of the invention which in principle is similar to the one according to FIG. 3 or FIG. 4, but in this embodiment the entire arrangement spring 4-adjusting means can be shifted in the vertical direction along the shell 7. For this purpose a lug 40 projecting outwardly from the crosspiece 5 is guided in a slot 41 in the shell 7. The lug 40 may comprise a handle and/or an adjusting or locking means, respectively, not shown in detail here. Additionally, the ends of the adjusting spindle 9 are guided in another slot 42 in the shell 7 so that the desired vertical movement is possible.

FIG. 13 is a schematic view of an embodiment which is based on another type of boot and in which the spring 4, similar as in the embodiment according to FIG. 9, rests with its crosspiece 5 against the outer surface of the shell 7, but is rigidly connected with the shell by a rivet 17. For adjusting the legs a bolt-nut arrangement, not shown in detail here, is provided, which corresponds to that according to FIG. 8, on the left.

It should be added that in many instances it may be of advantage when the spring is biased so that the legs move outwardly. The spring 4 may of course be made of a composite material, such as of steel coated with plastic or the like. Even if herein primarily a ski boot comprising a rear flap is shown, it is understood that the invention may be used in connection with completely different designs of ski boots, also in combination with other adjusting devices, such as for the height of the sole, the tensioning in the area of the instep, etc.

As shown in FIG. 1, one position of the spring 4, in which the legs 6 are inclined forwards and downwards, is particularly useful from the anatomical point of view, but the legs 6 may also extend in other directions, in particular horizontally.

What is claimed is:

1. A ski boot comprising an adjustable support for the foot positioned in the heel portion, characterized in that the support is a substantially U-shaped spring (4) whose crosspiece (5) is positioned in the heel portion of the shell (7) of the boot and whose legs (6) extend forward on both sides inside the shell (7), embracing the foot substantially between the ankle and the heel-bone, said legs (6) being adjustable in various relative positions with respect to each other by an adjusting means engaging the crosspiece (5) or the legs (6), said adjusting means (9) extending substantially horizontally and transversely to the boot and being supported on the shell (7) and extending through the legs (6) near the crosspiece (5), said adjusting means (9) being provided on both sides with nuts (10) fixed against rotation with respct to the spring (4), each nut (10) engaging an outer surface of the legs (6) (FIGS. 3, 4, 6), and said adjusting means (9) extending outwardly through the shell (7) at least on one side and being provided on one side with a handle (12) which permits turning of the adjusting means (9) FIGS. 3, 4, 6).

* * * * *